United States Patent [19]

Nemit

[11] 3,969,729

[45] July 13, 1976

[54] NETWORK-FED PHASED ARRAY ANTENNA SYSTEM WITH INTRINSIC RF PHASE SHIFT CAPABILITY

[75] Inventor: Jeffrey T. Nemit, Canoga Park, Calif.

[73] Assignee: International Telephone and Telegraph Corporation, New York, N.Y.

[22] Filed: Mar. 17, 1975

[21] Appl. No.: 558,705

[52] U.S. Cl. ..... 343/756; 343/100 SA; 343/768; 343/777; 343/854

[51] Int. Cl.[2] ..... H01Q 3/26

[58] Field of Search ..... 343/768, 854, 100 SA, 343/756, 777

[56] References Cited

UNITED STATES PATENTS 3,604,012 9/1971 Lindley ..... 343/768

*Primary Examiner*—Eli Lieberman

*Attorney, Agent, or Firm*—William T. O'Neil

[57] ABSTRACT

An integral element/phase shifter for use in a phase scanned array. A non-resonant waveguide or stripline type transmission line, series force feeds the elements of an array. In the embodiments shown, four RF diodes are arranged in connection within the slots of a symmetrical slot pattern in the outer conductive wall of the transmission line to vary the coupling therefrom through the slots to the aperture of each individual antenna element. Each diode thus controls the contribution of energy from each of the slots (at a corresponding phase) to the individual element aperture and therefore determines the net phase of the said aperture. Three species of the invention are shown, the first and second involving RF diodes in the slots of waveguide broad and narrow walls respectively, and the third having slots through the shield plane of a stripline. The invention facilitates array phase scanning without the need for separate, and relatively more expensive, discrete phase shifters for each antenna element.

16 Claims, 14 Drawing Figures

NARROW_WALL VARIPHASE COUPLER

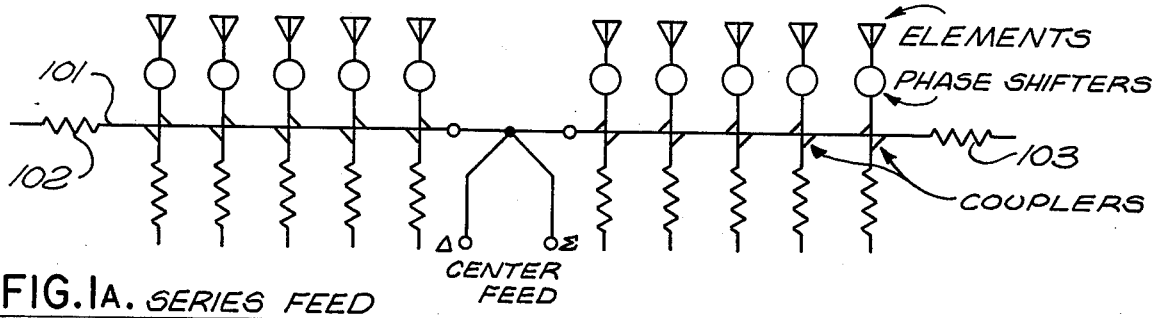
FIG. 1A. SERIES FEED
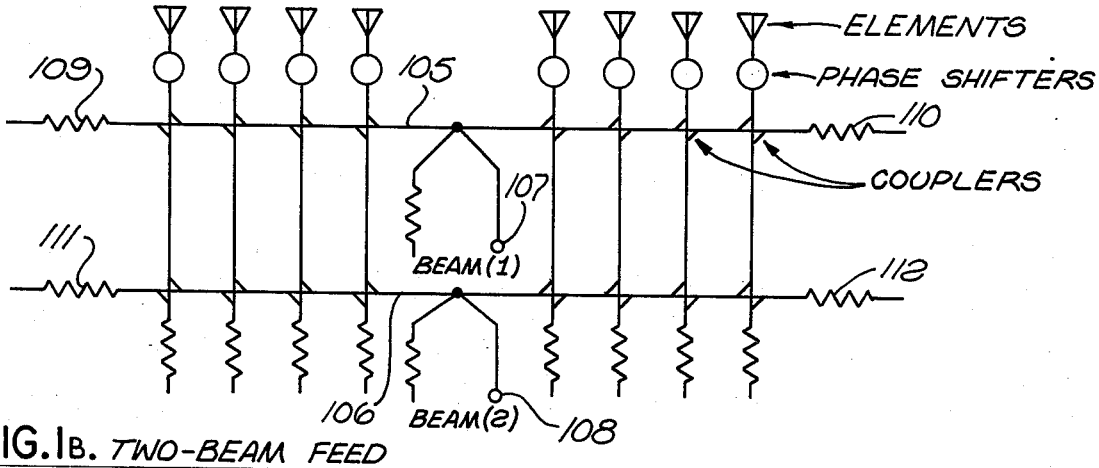
FIG. 1B. TWO-BEAM FEED
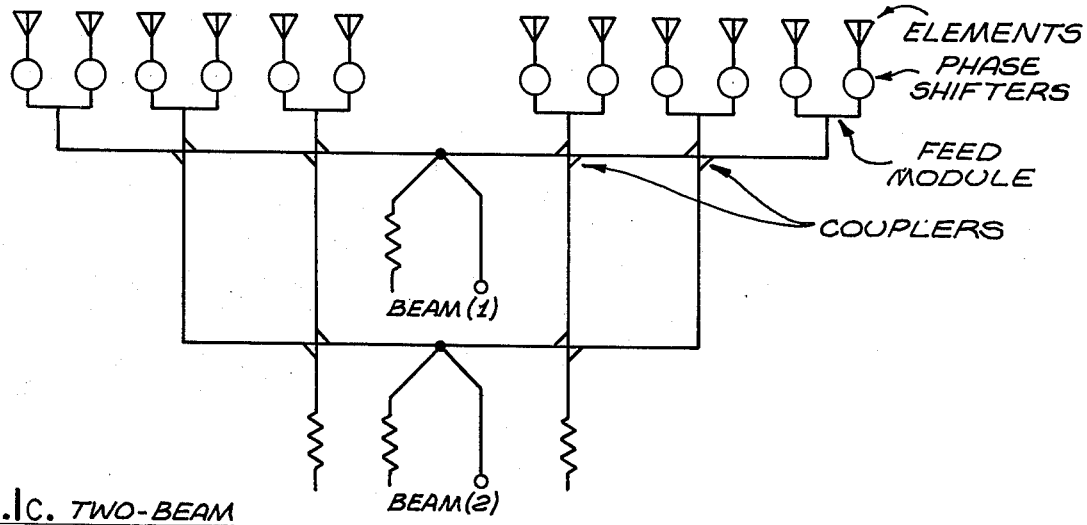
FIG. 1C. TWO-BEAM MODULAR FEED

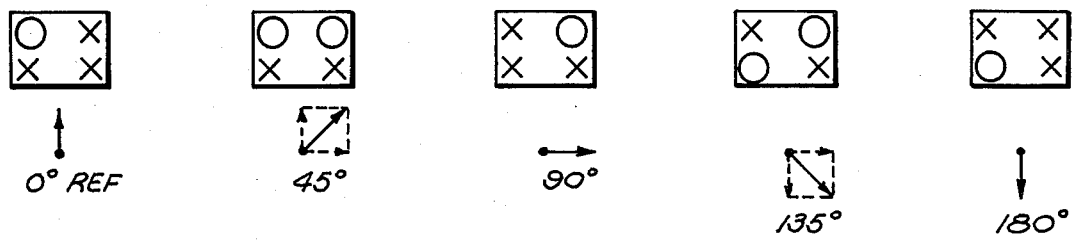
FIG.2A. COUPLING_SLOT CONFIGURATIONS
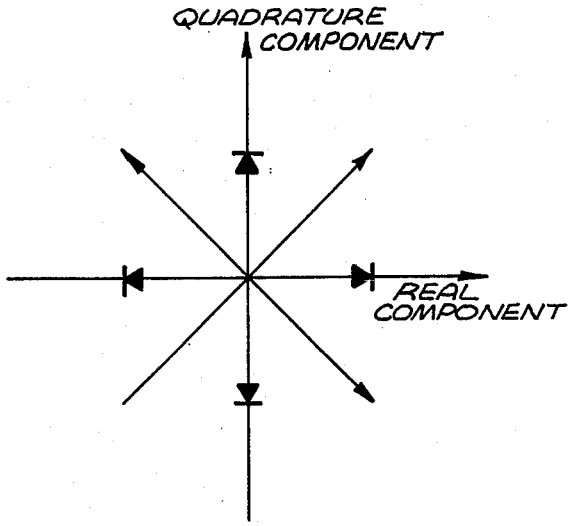
FIG.2B. EIGHT PHASE STATES FOR FOUR_DIODE VARIPHASE COUPLER.
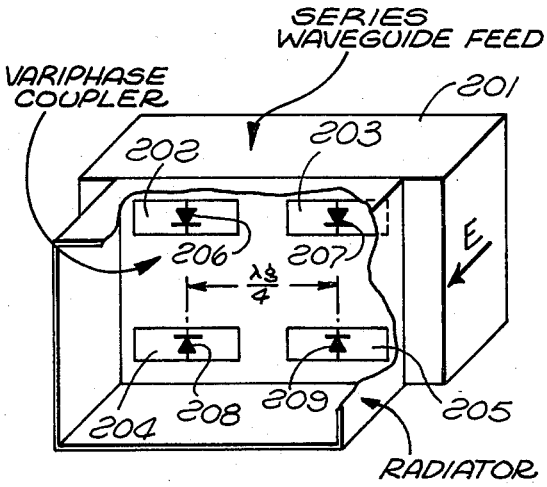
FIG.3. INTEGRATED ELEMENT/ PHASE SHIFTER. (BROADWALL COUPLING)
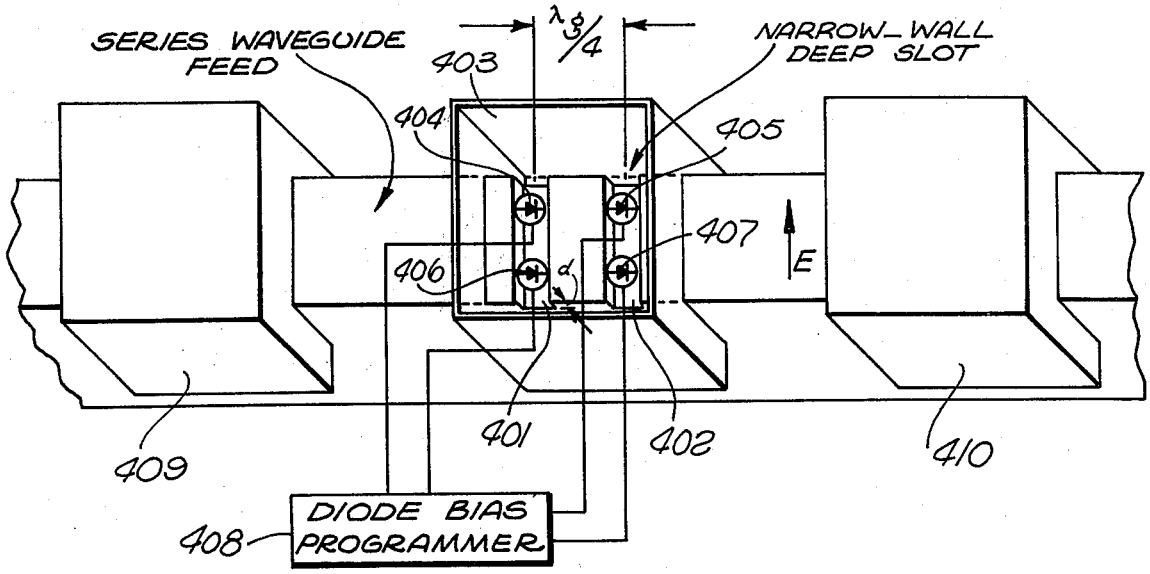
FIG.4. NARROW_WALL VARIPHASE COUPLER

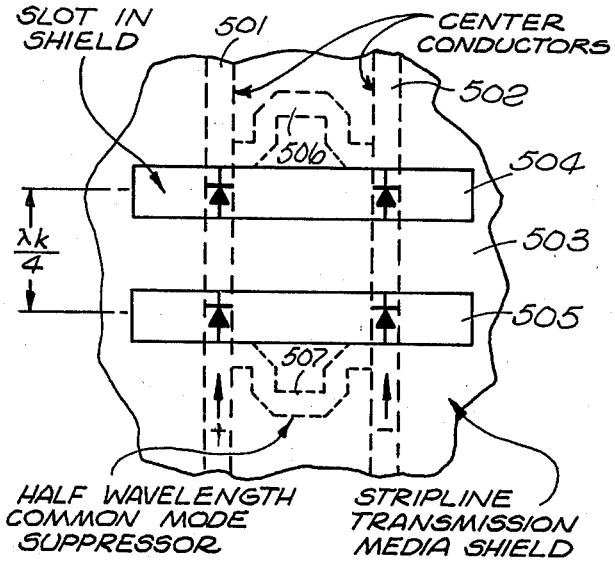
FIG.5A. STRIPLINE VARIPHASE COUPLER
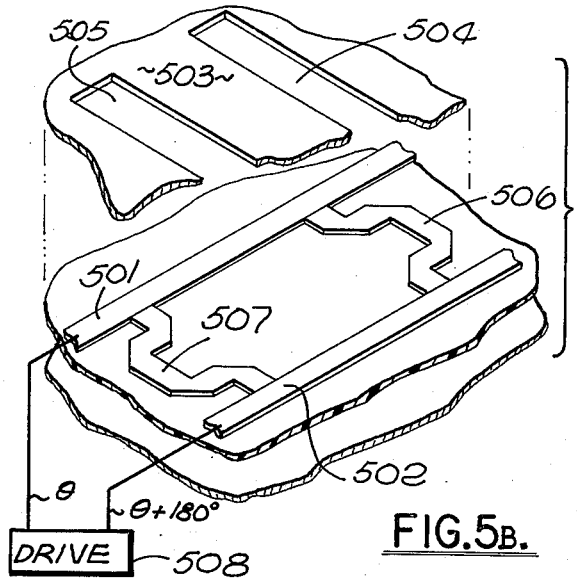
FIG.5B.
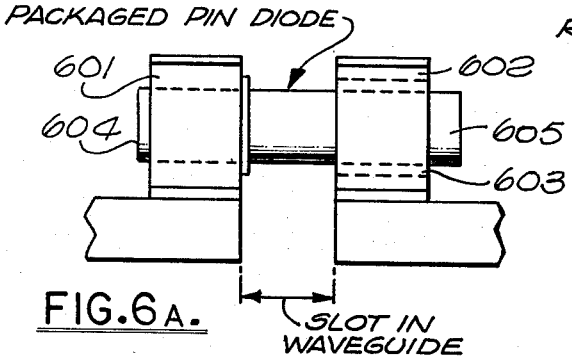
FIG.6A.
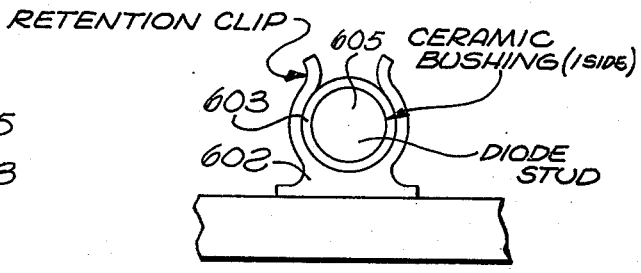
FIG.6B.
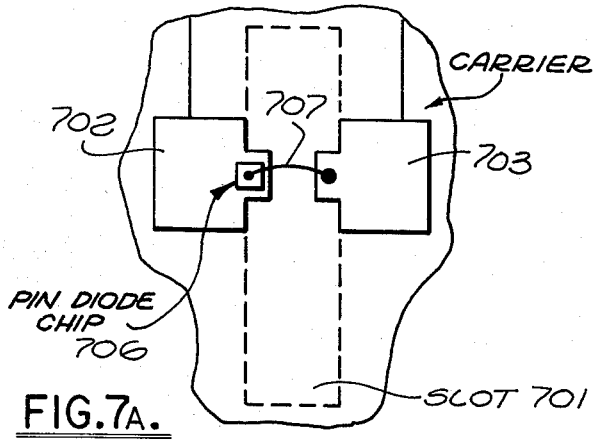
FIG.7A.
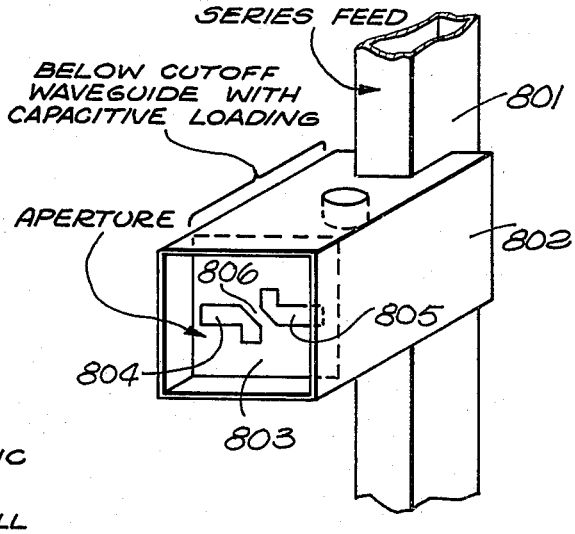
FIG.8. CIRCULAR POLARIZED ELEMENT.
FIG.7B.
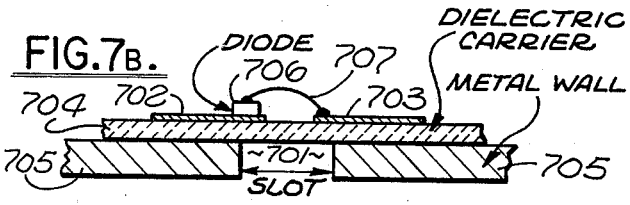

NETWORK-FED PHASED ARRAY ANTENNA SYSTEM WITH INTRINSIC RF PHASE SHIFT CAPABILITY

BACKGROUND OF THE INVENTION

1. Field of the Invention

The invention relates to inertialess radar scanning techniques in general, and more specifically to individually controlled radiating elements particularly adapted for use in phase scanning arrays.

2. Description of the Prior Art

Since the earliest times of radar system development, array antennas have been known per se, and have been used for the formation of sharply directive beams. Array antenna characteristics are determined by the geometric position of the radiators (elements) and the amplitude and phase of their individual excitations.

Intermediate radar developments, facilitated by the development of the magnetron and other high powered microwave transmitters, had the effect of pushing the commonly used radar frequencies upward. At those higher frequencies, simpler antennas became practical. Such simpler antennas usually included shaped (parabolic) reflectors illuminated by horn feed or other simple primary antenna.

As the radar art advanced, electronic (inertialess) scanning became important for a number of reasons, including scanning speed and the capability for random or programmed beam pointing. Since the development of electronically-controlled phase shifters and switches, attention has been redirected toward the array type antenna in which each radiating element can be individually electronically controlled. The text "Radar Handbook" by Merrill I. Skolnik, McGraw Hill (1970) provides a relatively current general background in respect to the subject of array antennas in general, particularly in Chapter 11 thereof.

Chapter 12 of the above-referenced textbook is devoted to "Phase Shifters for Arrays", such controllable phase shifting devices being a key element in the phased array prior art. The capability for rapidly and accurately switching beams thus afforded permits a radar to perform multiple functions interlaced in time, or even simultaneously. An electronically steered array radar may track a great multiplicity of targets, illuminate a number of targets with RF energy for the purpose of guiding missles toward them, perform wide-angle search with automatic target selection to enable selected target tracking and may even act as a communication system directing high gain beams toward distant receivers and/or transmitters. Accordingly, the importance of the phase-scanned array as a modern radar tool, is very great indeed.

In a phased-array system, a number of unique problem areas exist which have been at best, only partially solved and then at great expense and complexity, in accordance with prior art technology. These problems are typically concerned with the local feed, the phase shifters, the elements, and the type and quality of polarization.

The manner in which signal is distributed from a common input to the sub-array and thence to the elements of a particular array has a substantial effect on the total cost and performance of the array. Most arrays are designed from the following points of view: (1) An attempt is made to match the element active impedance, which varies with scan angle. (2) The element is driven from a matched phase shifter. (3) The group of elements is driven from a feed with matched, isolated, output ports.

The rational for the "matching" design approach is that a matched system results in maximum power transfer. Even in a well-designed antenna with wide scanning requirements, the element VSWR is likely however, to be not less than 6dB. It is necessary for the output ports of the feed to be well matched, because multiple reflections between the element and the feed result in problems as follows: (1) For reciprocal phase shifters, high spurious side-lobes are generated due to multiple passes of the reflected signals therethrough; these being re-radiated in spurious directions. (2) For non-reciprocal phase shifters, substantial variations in gain is experienced due to multiple passes of the reflected signals through the phase shifters, these being re-radiated in the main-beam direction.

The prior art design philosophy has resulted in systems with only moderate performance. The cost, moreover, has been high as each component part must be tightly controlled. The size and weight of the array is frequently a problem because it requires three basic elements in series for each radiating element.

The manner in which the present invention deals with the problems of the prior art to produce an integral antenna element and phase shifter will be evident as this description proceeds.

SUMMARY OF THE INVENTION

In accordance with the aforementioned state of the prior art in respect to phase scanned arrays, it may be said to have been the general objective of the present invention to provide a lower cost, lighter weight, phased scanned array. More particularly, it was desired to provide an integrated element/phase shifter (sometimes herein referred to as a variphase coupler, a variphase exciter), for inclusion in such array systems.

The variphase coupler, or exciter, is particularly suited for use with waveguide or stripline type array configurations and is based on new concepts enabling simpler phase scanned arrays with superior performance capabilities.

Basically, each radiating element is established by a symmetrical group of slots through a wall of the feed waveguide, these being each equipped with an admittance controllable RF diode located across the slot opening. A number of variations on the general principle of the invention are possible, and the description hereinafter presents three typical embodiments as follows: (1) A four slot symmetrical pattern in the broad wall of the guide with a controllable diode across each slot. (2) A narrow wall waveguide version in which a pair of deep slots are provided with two symmetrically disposed RF diodes across the opening of each such slot. (3) A stripline version in which a pair of slots through the stripline shield are provided and are transversely oriented with respect to the longitudinal center conductors. In this last mentioned embodiment, a pair of diodes are symmetrically disposed across each slot about the longitudinal centerline of the stripline.

In each embodiment, the diodes are programmed primarily between conditions of substantially no RF admittance and maximum RF admittance, although it will be understood from the description following that intermediate diode admittance states are possible. In the bi-static control arrangement however, the system is ideally suited to digital control.

The placement of the slots themselves provides for the energizing of the net aperture of each individual radiator element with the vector sum of the individual slot energies. Typically, each diode is in a position to control the application of energy at a phase representing one of the four orthogonally placed phase vectors. That is, if one diode is arbitrarily in control of the zero phase energy (reference phase), then the other three are correspondingly in control of −180°, + 90° and −90° discretely.

In accordance with a unique aspect of the present invention, the net phase of the aperture illumination is controllable in eight possible phase states, as will be more fully described hereinafter.

The device of the invention in each of the described basic embodiments operates with linear polarization. Circular polarization is readily provided however, by adding a parasitic dipole at the radiator face in a manner in which will be more fully described hereinafter.

The configuration of the invention offers unique advantages compared to other solid-state phase shifting techniques for phase scanning arrays, such as: (1) Each element in the array is force-fed independent of the aperture impedance. This occurs because the slot element is weaky coupled to the main guide and is fed by a virtual generator with near zero impedance. (2) Overall losses can be lower than achieved with conventional step type phase shifters. The novel exciter of the invention acts as a differential switch rather than acting to provide phase shift by differential loading as is commonly the case with the prior art discrete phase shifter associated with each radiator element in a prior art phase scanning array. Moreover, circuit losses are negligible in the configuration of the present invention. (3) The depth of the array may be exceptionally small, since the added depth of the exciter (variphase coupler) is negligible. (4) The approach should have a substantial impact on future array costs, the series feed and element housing can be fabricated by efficient processes already known for slot array construction. The switching elements may employ either discrete packaged diodes or diode or chips in a manner to be hereinafter more fully described.

The disclosed embodiments and their functional aspects will be more fully described hereinafter in connection with the drawings.

BRIEF DESCRIPTION OF THE DRAWINGS

FIGS. 1*a*, 1*b*and 1*c* are typical schematic configurations for phase scanned arrays of the series feed, two-beam feed, and two-beam modular feed, respectively.

FIG. 2*a* is a coupling-slot configuration diagram showing the net aperture phase obtainable for several combinations of diode control (bias) states.

FIG. 2*b* illustrates the eight-phase states achievable with a four-diode variphase coupler in accordance with the present invention.

FIG. 3 illustrates a broad wall waveguide embodiment of the variphase coupler in accordance with the present invention.

FIG. 4 illustrates the narrow-wall deep slot configuration in accordance with the present invention, in a section of series waveguide feed of a typical array.

FIG. 5*a* illustrates a stripline version of the variphase coupler.

FIG. 5*b* illustrates the internal construction of the stripline according to FIG. 5*a* in exploded form.

FIG. 6*a* illustrates the manner of mounting a packaged PIN diode for use with any of the embodiments of the present invention.

FIG. 6*b* is an end view of FIG. 6*a*.

FIG. 7*a* illustrates a typical application of a PIN diode chip as the controllable RF diode element in any of the embodiments of the present invention.

FIG. 7*b* is an end view of FIG. 7*a*.

FIG. 8 illustrates the application of a parasitic diode to achieve circular polarization in an element of an array in accordance with the present invention.

DESCRIPTION OF THE PREFERRED EMBODIMENTS

Referring now to FIGS. 1*a*, 1*b* and 1*c*, three different, well-known arrangements for phased arrays are depicted in schematic form. In FIG. 1*a*, the array is divided approximately in halves and is center fed by sum and difference terminals in a typical monopulse arrangement. A series feed transmission line, typically 101, feeds all elements on either side of center. End loads 102 and 103 are typical for this type of arrangement.

FIG. 1*b* is a center fed array arrangement in which two transmission lines, 105 and 106, separately couple energy to the same groups of individual phase shifter-/element combinations. Normally, this type of feed configuration would apply to a two-beam configuration. The center-fed transmission line 105 will be seen to be terminated by end loads 109 and 110 and the transmission line 106 is similarly terminated by end loads 111 and 112. Couplers distributed along the line between the center and the end load in each case couple energy to the individual phase shifter/element combinations separately. Accordingly, the feed ports or terminals 107 and 108 correspond respectively to the first and second beams. In this configuration, these first and second beams scan together as a pair, in accordance with a predetermined programming of the phase shifters.

FIG. 1*c* illustrates a modular feed two-beam arrangement constructed on a network principle. In the illustration of FIG. 1*c*, two phase shifter/element combinations comprise each feed module. Otherwise, the form and function of FIG. 1*c* is similar to that of FIG. 1*b*. In most radar applications where a monopulse or other beam cluster is required, the spacing beween beams is on the order of several beam widths. The spatial frequency of the aperture distribution is therefore low and can be synthesized in a simple modular fashion, as shown in FIG. 1*c*, for a linear array.

Although the configurations of FIGS. 1*a*, 1*b* and 1*c* are well-known in the prior art and have been variously implemented using the separate phase shifter and radiating element sub-combination, it is to be understood that each of these array arrangements also lends itself to the unique concept of the present invention, namely, the provision of the variphase coupler integrated element-phase shifter) device in accordance with the present invention.

Before proceeding with the detailed description of the various embodiments illustrated in accordance with the broad concept of the present invention, it is desirable to discuss the concept of force-feed or force-excitation as applied in the present invention.

The two approaches usually considered for exciting the elements of an array are the "constant incident power" method and the "force-fed" method. In the past, only the former method has been implemented in phased arrays. In connection with the use of the variphase coupler of the present invention, it has been determined that a force-fed array is not only feasible but can result in lower manufacturing costs and lower weight for a given array size as compared to an array of the same size excited by the constant-incident-power method. It will also be understood from the description hereinafter, that the use of the force-fed method actually produces superior electrical performance.

The most common polarized single-mode elements suitable for phased arrays are the dipole radiator and the slot radiator. The former is considered to be a current-type radiator since all the properties of the element are determined by the current distribution on it. The latter is a voltage-type radiator, since all the properties of the element are determined by the electric field distribution. Forced excitation for a dipole radiator is achieved by driving it from a constant-current source and for the slot radiator, forced excitation is achieved by excitation from a constant-voltage source.

In a phased array of current-type elements fed by variable-phase current sources, the element pattern in the array is equal to the isolated element pattern. This is true since, by superposition, if all the element excitations, except the one under test are set to zero, then the unexcited elements are open-circuited, and the induced currents on them must therefore, be zero. This feature of the force-fed array of elements has a number of advantages in terms of array design and performance predictability. Similar conclusions can be drawn for the voltage-type element fed by a variable-phase ideal voltage source.

The embodiments shown and described hereinafter, are all of the slot radiator type employing the constant-voltage feed concept. This is because of the generally low cost and relatively simple manufacturing techniques involved in the production of slot arrays formed within the walls of waveguide or stripline type transmission lines. It is to be understood however, that in the broad sense, the concept of the present invention could be applied to an array of current type radiators.

In a travelling wave (non-resonant) array, where the elements spacing is a non-integral multiple of the transmission line wavelength, it is known that the feed transmission line is well matched along its entire length. When each element is weakly coupled to the main transmission line, then the impedance of the virtual generator feeding that element is extremely small. This is tantamount to constant voltage excitation for a slot-type radiator. A constant-current source can be synthesized by adding a quarter-wave impedance inverter.

A travelling-wave series feed for a multi-element sub-array with a uniform excitation might have a nominal coupling of −15dB at the input side. The coupling is gradually increased along the array length to compensate for the power radiated by prior elements. For a well-designed feed, only 5% to 10% of the available power need be terminated in the end load.

From the foregoing, the skilled reader will understand what is meant by the force-fed element drive. The variphase coupler in accordance with the present invention makes it possible to achieve the superior electrical performance possible in accordance with any array design based on this force-feed concept. As already indicated hereinbefore, this concept has been relatively little used in connection with prior art arrays because of the unavailability of suitable electronically-controlled variable-phase coupling devices, such as provided by the present invention.

Passing now to FIG. 3, one form of the variphase coupler or variable phasing exciter, will be described in connection with the diagrams of FIGS. 2*a* and 2*b*.

Basically, the embodiment of FIG. 3 comprises four slots in the broad wall of a waveguide feed transmission line. The line generally along the length or longitudinal dimension of the waveguide 201 will be referred to hereinafter as horizontal, for convenience. In accordance with that convention, slots 204 and 206 are vertically stacked, one above the other, as are slots 203 and 205.

This four-slot grouping of FIG. 3 is symmetrical about the horizontal centerline of the broad wall of the waveguide and also symmetrical about a vertical line normal to said horizontal centerline. The horizontal spacing is one quarter guide wavelength center-to-center and the vertical spacing determines the amount of coupling from each individual slot.

If one considers the operation of the device in the absence of the diodes, the coupling from the waveguide series feed to the radiator 210, which in this case is a section of open-end waveguide, is essentially zero, since the excitation is antipodal. With the diodes present and in the reverse bias state, the diodes have a minimal effect on the coupling from the waveguide to the radiator, that is, the electrical condition is very little different than is the case were the diodes completely absent. In the forward bias state however, coupling can be significantly reduced. Positive or negative excitation is realized by differentially exciting a pair of vertical diodes. In view of the quarter wave center-to-center horizontal spacing of the vertical slot pairs, it will be realized that the left vertical pair thus provides zero and 180° phase states, and the right pair provides positive or negative excitation at the relative 90° phase relationships.

Referring now to FIGS. 2*a* and 2*b*, it will be seen that there are eight possible combinations of slot excitation corresponding to eight combinations of forward and back biasing of diodes 206 through 209 on FIG. 3. In FIG. 2*a*, the upper left slot (from FIG. 3) is arbitrarily taken as the 0° reference. The 45, 90, 135 and 180° net vector situations depicted in FIG 2a will be understood from the foregoing description.

It is interesting to note that the coupling amplitude in the diagonal phase states is 3dB higher than achieved in the off-diagonal states. It can be shown that the RMS errors are reduced by 3dB by employing all eight states rather than just the four principle states. The device of FIG. 3 may be thought of as equivalent to a 2 ½ bit phaser from an error sidelobe point of view. For loss considerations, the device may be thought of as equivalent to the 3 bit phaser.

From an understanding of the foregoing, it will be realized that additional phase states can be provided by adding more diode pairs. For example, diodes may be added near the edge of each slot. When these additional diodes are biased, the coupling is reduced Variable ratio I and Q (I/Q) channel signals can be synthesized, thereby producing additional phase states at the radiator aperture.

Referring now to FIG. 4, a second embodiment presents a somewhat different approach to the variphase coupler of the present invention. This embodiment offers a number of distinct advantages, and in many applications may be the preferred embodiment. Rather than slotting the broad wall of a waveguide transmission line employed as a series feed, as in FIG. 3, the embodiment of FIG. 4 employs narrow-wall deep slots. These slots intercept the longitudinal currents of the main guide, and when a pair of diodes are symmetrically driven in the forward or reverse bias states, the net coupling to the element, is zero. This is true because the slot intercepts equal and opposite currents on the top and bottom walls of the waveguide. If now the top diode, for example 404, is reversed bias and the bottom diode, for example 406, is forward biased, the coupling from the top of the slot will dominate and result in a positive signal. Conversely, the back biasing of the bottom diode 406 with 404 forward biased, produces dominant coupling from the bottom of the slot and the net signal will be negative. The plus or minus quadrature signals will be excited as before with a second slot, i.e., 402, spaced one quarter quide wavelength center-to-center, as illustrated in FIG. 4. As is the case with the embodiment of FIG. 3, more than eight phase states can be provided by adding more diodes to change the slot coupling to the waveguide. The embodiment of FIG. 4 provides stronger coupling than that of FIG. 3 since the longitudinal, rather than transverse waveguide currents, are intercepted by the slot. Variable coupling can be effected in any given narrow-wall slot, as shown in FIG. 4, by controlling the depth of the slot. The depth of the slot is, of course, the amount (*d*) that it extends into the plane of the broad walls above and below the narrow wall of interest. An additional important point is the fact that the waveguide form factor achieved in the configuration of FIG. 4, is more easily made compatible with the element spacing requirements of area phased arrays.

Still further, the diode switching network employed in the embodiment of FIG. 4, being restricted to the narrow wall, results in a standard form factor in the plane of the narrow guide wall, independent of the desired coupling value.

FIG. 4 also shows a diode bias programmer 408 which is readily instrumented to provide the back or forward biases (discretely for each variphase coupler in an array) in a sequence predetermined to produce the corresponding program of beam pointing from the array. Also, FIG. 4 indicates in outline only, two additional integrated-element/phase shifters 409 and 410, associated with the same series waveguide feed. This partial array arrangement is intended to convey association with the array configurations of FIGS. 1*a*, 1*b* and 1*c*, or other array arrangements to which the present invention is readily applicable.

Referring now to FIGS. 5*a* and 5*b*, an embodiment is illustrated which applies the concepts of the present invention to stripline transmission media. The use of slots as radiating elements is also well known in connection with strip transmission line, and is described in the literature. For example, U.S. Pat. 3,518,688, entitled "Microwave Strip Transmission Line Adapted For Integral Slot Antenna" describes a slotted radiator stripline structure generally suited to the embodiment of FIGS. 5*a* and 5*b*. In FIGS. 5*a* and 5*b*, a pair of strips 501 and 502 are driven in phase opposition. Slots through the conductive shield 503 intercept longitudinal currents. Again, the slot spacing is ($\lambda k/4$), i.e., a quarter stripline wavelength from center-to-center between slots, ($\lambda k$ being the stripline wavelength). In addition to common mode suppressors 506 and 507, which are well understood in this art, suppression screws (not shown) would normally also be provided to inhibit higher-order modes in the stripline.

Coupling of energy through the slots 504 and 505 through the conductive shield plane 503, is controlled by the length of these slots measured transversely with respect to the longitudinal dimension of the center conductors 501 and 502. Since the two center conductors 501 and 502 are driven in phase opposition, it will be apparent that the four orthogonally related phase vectors are available under the control of each of the four diodes. Driving the diode pair anti-symmetrically enhances the positive or negative excitation in a manner similar to that obtained in the embodiment of FIG. 4. The particular advantage of the stripline embodiment of the present invention as characterized in FIGS. 5*a* and 5*b*, is the capability for producing a more compact structure for some types of modular arrays.

In general, the embodiment of FIG. 4 is likely to be the most efficient and cost effective integrated element/phase shifter (variphase coupler) in accordance with the present invention.

Passing on to FIGS. 6*a* and 6*b*, one suitable form of RF diode mounting (by means of a packaged PIN diode) is illustrated. It will be understood that the slot and waveguide identified in FIG. 6*a* could also be the slot in the stripline embodiment of FIGS. 5*a* and 5*b*. Retention clips 601 and 602 contact the PIN diode at its studs 604 and 605, respectively. The connection is metal-to-metal between 601 and 604, however, retention clip 602 is insulated from the diode stud 605 by means of a ceramic bushing 603. The RF path between the retention clips and therefore, between the sides of the particular slot passes through the ceramic bushing 603, however, the control signal (forward or back bias) may, in this way, be applied to the diode without being short circuited. Similar techniques are well known in connection with other applications of PIN diodes in RF circuitry, as, for example, in RF switching applications.

The "discrete package" PIN diode depicted in FIGS. 6*a* and 6*b* is most suitable for frequencies below the so-called C band. A heat-sink is automatically provided by the mass of the waveguide metallic wall, and clip 601 makes a firm electrical and thermal contact at the heat-sink end of the diode 604, thereby providing for conduction of internally generated heat from the PIN diode.

The principal advantages of the discretely packed packaged diode include high average power capacity in view of the aforementioned heat-sink arrangement, and the low order of sealing required of the overall variphase coupler device. In addition, the discretely packaged PIN diode provides a high breakdown voltage, thereby increasing peak power capability. Still further, the length of most coupling slots is below resonance and the capacitance of the packaged diode can be utilized to resonate the slot and increase the coupling, if desired.

At higher operating frequencies, for example, above S-band, the capacitance of the packaged diode tends to reduce the switching action of the device. Accordingly, an alternate form, employing chip-type PIN diodes, may be used. FIGS. 7*a* and 7*b* illustrate the manner in which such chip-type diodes are employed. A top view of a slot 701 with a PIN diode chip 706 is illustrated in FIG. 7*a*. From the end view, FIG. 7*b*, it will be noted that a dielectric carrier, such as a sheet of ceramic material 704, bridges the slot 701, overlapping the metal transmission line wall 705. Conductive plates 702 and 703, which may actually be metalized areas on the ceramic material 704, provide for application of bias potential to the diode 706 and also for RF grounding (bypassing) through the dielectric layer 704 to the waveguide (or other transmission line) conductive wall 705. A jumber 707 completes the diode RF and biasing circuit across the slot 701. The dielectric 704 can also serve as a dust and moisture cover or seal, but an additional insulating sealing material can be applied over the top of 702 and 703, if necessary.

FIG. 8 illustrates the addition of a circular polarization capability to a variphase coupler/radiator, this arrangement being applicable, for example, to the configuration of FIG. 4. The narrow-wall slotted guide 801 couples into the below cut-off waveguide 802, the latter including capacitive loading. Within the aperture of 802, a pair of printed dipoles are emplaced on the randome cover of the radiating element. The dipole, being cpacitively coupled to the slot, carries currents in phase quadrature with respect to the slot voltage, thus yielding the desired circular polarization. Switchability between linear and circular polarization may be achieved by adding a PIN diode across the center gap 806 between the dipole halves 804 and 805. Back and forward biasing of such a diode could be effected in a manner much the same as described in connection with the slots of the various embodiments of the invention hereinbefore described. The radome cover 803 in FIG. 8 may actually be a dielectric window to resonate the aperture and improve the bandwidth in accordance with well understood principles. That expedient is, of course, also available in connection with the embodiments of FIGS. 3, 4 and 5. It will be understood that the stripline embodiment of FIG. 5 also includes an open-end radiator guide, such as 403 on FIG. 4, although this is omitted from the drawing to avoid confusion.

Although the embodiments described contemplate the use of PIN diodes in the switching mode only, that is, either fully backed biased or well forward biased, it is also known the diodes present variable substantially wholly real impedance characteristics at intermediate bias currents. Accordingly, the diode bias programmer (for example, 408 in FIG. 4) can be designed to provide a form of analog phasing by judicious selection of intermediate, as well as bistatic (forward or reverse) bias states.

It will be realized by those skilled in this art that a second slot pattern on the opposite face of the waveguide or stripline can be provided, thereby implementing a "two-way looking" scanner.

Once the principles of the present invention are fully understood, various other modifications and variations will suggest themselves to those skilled in this art. Accordingly, it is not intended that the specification description or drawing illustration of the various embodiments should be considered as limiting the scope of the present invention. These are to be regarded and illustrative only.

What is claimed is:

1. An integral antenna element and RF phase shifter particularly for use as a controllable element in a phase scanned array fed from an RF transmission line of a type selected from a group including waveguide and stripline, said transmission line having longitudinal conductive outer walls through which RF energy may be coupled by means of slots, comprising:

means including a pair of slot patterns through one of said outer walls, the slots of said patterns being placed symmetrically about the longitudinal centerline of said one outer wall, each of said slot patterns thereby capable of providing coupling on both sides of said longitudinal centerline of said outer wall;

and means including at least four RF devices each of a type capable of providing a controlled RF admittance path for providing admittance ranging at least between discrete minimum and maximum values as a function of a corresponding control signal applied thereto, at least two of said RF devices being placed to control corresonding admittance paths within one of said slot patterns with one of said RF devices on each side of said longitudinal centerline of said outer wall.

2. Apparatus according to claim 1 in which each of said RF devices is defined as comprising at least one RF diode, said control signal being applied thereto as a controllable bias to produce said controlled admittance path.

3. Apparatus according to claim 2 in which said transmission line is a waveguide, said slot patterns each include at least one substantially rectangular slot, and each of said diodes is connected to provide at least a portion of said admittance path across the small dimension of a corresponding one of said slots.

4. Apparatus according to claim 2 in which said transmission line is a stripline, said slot patterns each include at least one substantially rectangular laterally extending slot, and each of said diodes is connected to provide at least a portion of said admittance path across the small dimension of a corresponding one of said slots.

5. Apparatus according to claim 3 in which said slots are also equally divided and symmetrically placed about a line on a waveguide broad wall normal to said longitudinal axis.

6. Apparatus according to claim 5 in which the center-to-center spacing of said slots in the direction of said longitudinal axis is one quarter guide wavelength.

7. Apparatus according to claim 3 in which said slots comprise two, transverse, deep, narrow-wall slots spaced one quarter guide wavelength, center-to-center, measured in the direction of said longitudinal axis.

8. Apparatus according to claim 7 in which said diodes are two in number in each of said slots, said diodes being located symmetrically with respect to the longitudinal centerline of said waveguide projected to said narrow-wall.

9. Apparatus according to claim 4 in which said stripline is further defined as having a pair of laterally-spaced, substantially coplanar, longitudinally extending conductive strips mounted in parallel relation to and between a pair of coplanar conductive shields, and said slots are transverse and two in number, are mutually parallel and are spaced one quarter guide wavelength measured in the direction of the longitudinal axis of said stripline.

10. Apparatus according to claim 9 in which the long dimensions of said slots extend transversely by a predetermined amount greater than the transverse center-to-center spacing of said conductive strips within said stripline.

11. Apparatus according to claim 2 in which said RF diodes are defined as PIN diodes.

12. Apparatus according to claim 2 in which each of said diodes provides at least first and second discrete values of admittance through each of said diodes in response to corresponding first and second levels of said bias.

13. In a phase-scanned array including a plurality of radiating elements series force-fed from a non-resonant RF transmission line of a type selected from the general group including waveguide and stripline having a conductive outer wall; apparatus operatively associated with each of said elements for varying the phase RF energy at a corresponding element aperture comprising:

a plurality of slots in a predetermined pattern through said outer wall of said transmission line, said slots being arranged to couple energy therethrough in at least four discrete relative phases to said element aperture formed adjacent to said slot pattern, to provide a summed signal at said element aperture;

means comprising at least one RF diode across each of said slots, said diodes each providing a conductive RF path in response to the forward biasing condition of a corresponding applied control signal and substantially no RF conduction in response to the reverse biasing condition of said control signal;

and means for programming the application of said control signals to at least some of said diodes thereby to control the net phase of said summed signal.

14. Apparatus according to claim 13 in which said diodes are four in number and are arranged to discretely control energy coupling through said outer wall in 0°, 180°, + 90° and −90° relative phases.

15. Apparatus according to claim 14 in which a radiator device comprising a section of open-ended waveguide is provided for each of said elements, each arranged to be excited from the corresponding one of said patterns of slots.

16. Apparatus according to claim 15 in which each of said open-ended waveguides is constructed to be below cut-off at the operating frequency, in which capacitive loading is included for each of said elements, and in which a parasitic dipole is included within each of said element apertures for producing circular polarization.

* * * * *